US012781372B2

(12) United States Patent
Yevtushenko et al.

(10) Patent No.: US 12,781,372 B2
(45) Date of Patent: Nov. 3, 2026

(54) ELECTROPLATING COMPOSITION FOR DEPOSITING A CHROMIUM OR CHROMIUM ALLOY LAYER ON A SUBSTRATE

(71) Applicant: Atotech Deutschland Gmbh & Co. KG, Berlin (DE)

(72) Inventors: Oleksandra Yevtushenko, Berlin (DE); Anke Walter, Berlin (DE); Simon Pape, Berlin (DE)

(73) Assignee: Atotech Deutschland Gmbh & Co. KG, Berlin (DE)

( * ) Notice: Subject to any disclaimer, the term of this patent is extended or adjusted under 35 U.S.C. 154(b) by 234 days.

(21) Appl. No.: 18/557,972

(22) PCT Filed: Apr. 29, 2022

(86) PCT No.: PCT/EP2022/061448
§ 371 (c)(1),
(2) Date: Oct. 30, 2023

(87) PCT Pub. No.: WO2022/229373
PCT Pub. Date: Nov. 3, 2022

(65) Prior Publication Data

US 2024/0200219 A1 Jun. 20, 2024

(30) Foreign Application Priority Data

Apr. 30, 2021 (EP) ..... 21171655

(51) Int. Cl.

| | |
|---|---|
| ***C25D 3/06*** | (2006.01) |
| ***C25D 3/08*** | (2006.01) |
| ***C25D 3/10*** | (2006.01) |
| ***C25D 3/56*** | (2006.01) |
| ***C25D 5/00*** | (2006.01) |

(52) U.S. Cl.
CPC ..... *C25D 3/06* (2013.01); *C25D 3/08* (2013.01); *C25D 5/627* (2020.08)

(58) Field of Classification Search
CPC ... C25D 3/06; C25D 3/08; C25D 3/10; C25D 3/56; C25D 5/627
USPC ..... 205/109, 243, 285, 287, 290
See application file for complete search history.

(56) References Cited

U.S. PATENT DOCUMENTS

| | | | | |
|---|---|---|---|---|
| 10,662,540 | B2 | 5/2020 | Abbott et al. | |
| 2012/0111731 | A1* | 5/2012 | Chapaneri | C25D 3/06 205/288 |
| 2018/0266008 | A1 | 9/2018 | Konigshofen et al. | |
| 2019/0301038 | A1 | 10/2019 | Nakatani et al. | |

FOREIGN PATENT DOCUMENTS

| | | | | |
|---|---|---|---|---|
| EP | 0182964 | A1 * | 6/1986 | C25D 3/565 |
| JP | H0565700 | A | 3/1993 | |
| JP | H0664918 | A | 3/1994 | |
| JP | 5890394 | B2 | 2/2016 | |
| KR | 100226912 | B1 * | 10/1999 | C25D 3/565 |
| RU | 2231581 | C1 | 6/2004 | |
| TW | 201400645 | A | 1/2014 | |
| WO | 2014110416 | A1 | 7/2014 | |
| WO | 2022123979 | A1 | 6/2022 | |

OTHER PUBLICATIONS

Steck et al., "Zinc-Chromium Coated Steel Sheet: Properties and Production," The 8th International Conference on Zinc and Zinc Alloy Coated Steel Sheet Galvatech (2011), pp. 1-8. (Year: 2011).*
PCT/EP2022/061448; International Search Report and Written Opinion of the International Searching Authority dated Sep. 28, 2022.
N. A. Polyakov et al., "Electrodeposition of Composite Chromium Coatings from Cr(III) Sulfate-Oxalate Solution Suspensions Containing Al2O3, SiC, Nb2N, and Ta2N Particles", Journal of Protection of Metals and Physical Chemistry of Surfaces, vol. 46, No. 1, 75-81 (2010).
Hung-Hua Sheu et al., "Effects of alumina addition and heat treatment on the behavior of Cr coatings electroplated from a trivalent chromium bath", Journal of the Taiwan Institute of Chemical Engineers, 48, 73-80 (2015).
Hung-Hua Sheu et al., "Improve the mechanical properties and wear resistance of Cr-C thin films by adding Al2O3 particles", Journal Surface & Coating Technology, 350, 1036-1044 (2018).

* cited by examiner

*Primary Examiner* — Edna Wong
(74) *Attorney, Agent, or Firm* — Renner, Otto, Boisselle & Sklar, LLP

(57) ABSTRACT

The present invention refers to an electroplating composition for depositing a chromium or chromium alloy layer on a substrate, the composition comprising (i) trivalent chromium ions, (ii) at least one complexing agent for the trivalent chromium ions, and (iii) at least one kind of oxide-hydroxide particles; a method for depositing a respective chromium and chromium alloy layer; a respective use of the particles; and respective substrates comprising such a chromium or chromium alloy layer.

5 Claims, No Drawings

ELECTROPLATING COMPOSITION FOR DEPOSITING A CHROMIUM OR CHROMIUM ALLOY LAYER ON A SUBSTRATE

This application is a national phase of International Application No. PCT/EP2022/061448, filed 29 Apr. 2022, which claims priority to European Patent Application No. 21171655.0, filed 30 Apr. 2021, each of which is hereby incorporated herein by reference in its entirety.

FIELD OF THE INVENTION

The present invention refers to an electroplating composition for depositing a chromium or chromium alloy layer on a substrate, said composition comprising (i) trivalent chromium ions, (ii) at least one complexing agent for the trivalent chromium ions, and (iii) at least one kind of oxide-hydroxide particles; a method for depositing a respective chromium and chromium alloy layer; a respective use of said particles; and respective substrates comprising such a chromium or chromium alloy layer.

BACKGROUND OF THE INVENTION

Functional chromium layers usually have a much higher average layer thickness, typically from at least 1 μm up to several hundreds of micrometers, compared to decorative chromium layers, which are typically below 1 μm. Furthermore, functional chromium layers are characterized by excellent hardness and wear resistance such that they are also typically named hard chromium layers.

Functional chromium layers obtained from an electroplating composition containing hexavalent chromium are known in the prior art and are a well-established standard.

During recent decades, such hexavalent chromium-based electroplating compositions and methods, respectively, are more and more replaced by trivalent chromium-based electroplating compositions and methods, which are much more health- and environment friendly.

Furthermore, trivalent chromium-based electroplating compositions and methods, respectively, utilizing particles are known in the art.

In the Journal of the Taiwan Institute of Chemical Engineers, 48, 73-80 (2015), Hung-Hua Sheu et al. refers to a trivalent chromium bath comprising $Al_2O_3$ particles.

In the Journal of Protection of Metals and Physical Chemistry of Surfaces, Vol. 46, No. 1, 75-81 (2010), N. A. Polyakov et al. refers to a Cr(III) sulfate-oxalate solution suspension containing $Al_2O_3$.

In the Journal Surface & Coating Technology, 350, 1036-1044 (2018), Hung-Hua Sheu et al. refers to a trivalent chromium bath comprising $Al_2O_3$ particles.

JP 5890394 B2 refers to an aqueous solution containing a trivalent chromium compound and ceramic particles such as $Al_2O_3$.

RU 2231581 C1 refers to a chromium electrolyte containing Cr(III) salts and $Al_2O_3$ powder.

It is well reported that incorporating $Al_2O_3$ particles can reduce the number of cracks in a respective chromium and chromium alloy layer. However, even in the presence of such particles, the chromium and chromium alloy layer usually does not change its typical bright and shiny silver-like chromium appearance.

However, even for hard chromium layers a less shiny appearance is sometimes desired. For example, it is in some cases needed to provide a layer with reduced reflection. This can potentially increase safety measures and avoid accidents. Therefore, there is a demand to further improve existing electroplating compositions in this regard.

Objective of the Present Invention

It was therefore an objective of the present invention to provide a trivalent chromium-based electroplating composition for depositing a chromium or chromium alloy layer, which significantly further reduces the number of cracks as well as the width thereof and additionally decreases the brightness of a respective chromium and chromium alloy layer.

It was furthermore an objective of the present invention to achieve this effect in a simple and effective way.

SUMMARY OF THE INVENTION

These objectives mentioned above are solved by an electroplating composition for depositing a chromium or chromium alloy layer on a substrate, said composition comprising:

(i) trivalent chromium ions, (ii) at least one complexing agent for the trivalent chromium ions, and (iii) at least one kind of oxide-hydroxide particles.

Own experiments have shown that by utilizing said at least one kind of oxide-hydroxide particles the number of cracks in a respective chromium and chromium alloy layer is further reduced compared to commonly utilized oxide particles as well as the width thereof. Furthermore, and importantly, also the brightness of said layer is significantly reduced. In fact, the layer shows a very desired reduced brightness and can be described as matt (at least with a significantly reduced reflection). This was surprising because this combined effect was unexpected. As shown in the examples below, this combined effect was not obtained with particles only having an oxide, e.g. $Al_2O_3$.

Furthermore, the electroplating composition of the present invention is quite simple because the combined effect is caused by one particularly kind of particles. No combination of particles or various chemical compounds are needed to achieve this effect. This is particularly relevant because mere oxide particles seem to not provide this combined effect.

In the context of the present invention, oxide-hydroxide particles denote particles, which chemically comprise a combination of an oxide and at the same time a hydroxide (i.e. a compound combining oxygen and hydroxide, e.g. expressed as XO(OH), wherein X is a counter ion/moiety at least partially compensating the negative charges of the oxygen and hydroxide). Typically, X comprises a metal.

In the context of the present invention, the term "at least one" or "one or more" denotes (and is exchangeable with) "one, two, three or more" and "one, two, three or more than three", respectively. Furthermore, "trivalent chromium" refers to chromium with the oxidation number +3. The term "trivalent chromium ions" refers to $Cr^{3+}$-ions in a free or complexed form. Furthermore, "hexavalent chromium" refers to any compound (including ions) comprising the element chromium with the oxidation number +6.

DETAILED DESCRIPTION OF THE INVENTION

The Electroplating Composition:

Preferred is an electroplating composition of the present invention comprising water, preferably comprising 50 wt.-% or more, based on the total weight of the electroplating composition, preferably 60 wt.-% or more, more preferably 70 wt.-% or more, even more preferably 80 wt.-% or more, yet even more preferably 90 wt.-% or more, most preferably 95 wt.-% or more. As a result, the electroplating composition of the present invention is preferably aqueous.

Preferred is an electroplating composition of the present invention, having a pH ranging from 4.1 to 7.0, preferably from 4.5 to 6.5, more preferably from 5.0 to 6.0, most preferably from 5.3 to 5.9. Thus, the electroplating composition is preferably acidic. The preferred acidic pH ranges are in particular beneficial for effectively depositing a chromium or chromium alloy layer on the substrate having the desired qualities, such as hardness and wear resistance.

Preferred is an electroplating composition of the present invention, wherein the trivalent chromium ions are present in a total concentration ranging from 5 g/L to 40 g/L, based on the total volume of the electroplating composition, preferably from 10 g/L to 30 g/L, more preferably from 14 g/L to 27 g/L, most preferably from 17 g/L to 24 g/L.

With the concentration ranges defined above, a very effective deposition of the chromium and chromium alloy layer on the substrate can be achieved. If the total amount of trivalent chromium ions is too low in many cases an insufficient deposition is observed, and the deposited chromium is usually of low quality. If the total amount is significantly exceeding 40 g/L, the electroplating composition is not any longer stable, which includes formation of undesired precipitates.

Preferred is an electroplating composition of the present invention, wherein the trivalent chromium ions of the electroplating composition are obtained from a soluble, trivalent chromium ion containing source, typically a water-soluble salt comprising said trivalent chromium ions. A generally preferred, well available, and cost-efficient water-soluble salt is alkaline trivalent chromium sulfate.

Preferably, the soluble, trivalent chromium ion containing source comprises alkali metal cations in a total amount of 1 wt.-% or less, based on the total weight of said source. In some cases, preferably, such a source is utilized for replenishing trivalent chromium ions if a respective deposition method is operated continuously. A preferred water-soluble salt comprising said trivalent chromium ions is alkali metal free trivalent chromium sulfate or alkali metal free trivalent chromium chloride.

More preferably, the soluble, trivalent chromium ion containing source comprises or is chromium sulfate, more preferably acidic chromium sulfate, even more preferably chromium sulfate with the general formula $Cr_2(SO_4)_3$ and a molecular weight of 392 g/mol.

More preferably, for replenishing, a soluble, trivalent chromium ion containing source is preferred, wherein the anion is an organic anion, preferably an organic acid anion, most preferably formate and/or acetate.

Preferred is an electroplating composition of the present invention, wherein the at least one complexing agent for the trivalent chromium ions is selected from the group consisting of organic complexing agents and salts thereof, preferably carboxylic acids and salts thereof, more preferably aliphatic carboxylic acids and salts thereof, most preferably aliphatic mono-carboxylic acids and salts thereof. Preferred aliphatic mono-carboxylic acids and salts thereof are $C_1$-$C_{10}$ aliphatic mono-carboxylic acids and salts thereof, preferably $C_1$-$C_8$ aliphatic mono-carboxylic acids and salts thereof, more preferably $C_1$-$C_6$ aliphatic mono-carboxylic acids and salts thereof, most preferably $C_1$-$C_3$ aliphatic mono-carboxylic acids and salts thereof. Most preferably, the at least one complexing agent comprises at least formate and/or acetate. As a result, the trivalent chromium ions can be efficiently stabilized in the electroplating composition by the complexing agents, preferably at the pH as defined above. Typically, such complexing agents are incorporated as carbon into the said chromium or chromium alloy layer, respectively.

Preferred is an electroplating composition of the present invention, wherein the at least one complexing agent for the trivalent chromium ions is present in a total concentration ranging from 50 g/L to 350 g/L, based on the total volume of the composition, preferably from 70 g/L to 320 g/L, more preferably from 90 g/L to 300 g/L, even more preferably from 100 g/L to 250 g/L, most preferably 120 g/L to 210 g/L.

The electroplating composition of the present invention comprises (iii), at least one kind of oxide-hydroxide particles. The particles are preferably solid. As a result, the electroplating composition of the present invention is preferably a suspension. Thus, the electroplating composition of the present invention is preferably not colloidal.

Preferred is an electroplating composition of the present invention, wherein the at least one kind of oxide-hydroxide particles comprise a metal, preferably a main group metal and/or a transition metal, wherein a main group metal is preferred. A preferred transition metal comprises iron and/or manganese. A preferred main group metal comprises aluminium.

Thus, more preferably, the metal comprises aluminium, most preferably the metal is (substantially) aluminium and (substantially) no other metals are preferably present in said particles.

Thus, preferred is an electroplating composition of the present invention, wherein the at least one kind of oxide-hydroxide particles comprises aluminum.

More preferred is an electroplating composition of the present invention, wherein the at least one kind of oxide-hydroxide particles comprises AlO(OH), preferably alpha-AlO(OH) and/or gamma-AlO(OH), most preferably gamma-AlO(OH).

Most preferred is an electroplating composition of the present invention, wherein the at least one kind of oxide-hydroxide particles is AlO(OH), preferably alpha-AlO(OH) and/or gamma-AlO(OH), most preferably gamma-AlO(OH). Thus, most preferably no other oxide-hydroxide particles are present. Most preferably these are the only particles in the electroplating composition.

Preferred is an electroplating composition of the present invention, wherein the at least one kind of oxide-hydroxide particles (i.e. (iii)) has a total amount ranging from 0.1 g/L to 200 g/L, based on the total volume of the electroplating composition, preferably from 1 g/L to 100 g/L, more preferably from 3 g/L to 80 g/L, even more preferably from 5 g/L to 60 g/L, yet even more preferably from 8 g/L to 40 g/L, most preferably from 10 g/L to 30 g/L. If the total amount is too low, i.e. below 0.1 g/L, not enough particles are incorporated and, as a result, no desired reduction in brightness is typically observed as well as a too low reduction of cracks. In contrast, if the total amount is significantly exceeding 200 g/L, in many cases the particles tend to sediment and an insufficient distribution of the particles is obtained, possibly along with defects in the chromium and chromium alloy layer.

Generally preferred is an electroplating composition of the present invention, wherein the at least one kind of oxide-hydroxide particles have a particle size ranging from 0.05 μm to 15 μm, preferably from 0.08 μm to 10 μm, more preferably from 0.11 μm to 8 μm, even more preferably from 0.21 μm to 6 μm, most preferably from 0.31 μm to 3 μm.

Preferred is an electroplating composition of the present invention, wherein the at least one kind of oxide-hydroxide particles have a particle size $D_{50}$ ranging from 0.1 μm to 15 μm, preferably from 0.2 μm to 10 μm, more preferably from 0.4 μm to 7 μm, even more preferably from 0.6 μm to 5 μm, most preferably from 0.8 μm to 3.5 μm.

Preferred is an electroplating composition of the present invention, wherein the at least one kind of oxide-hydroxide particles have a particle size $D_{10}$ ranging from 0.05 μm to 2 μm, preferably from 0.1 μm to 1.5 μm, more preferably from 0.15 μm to 1 μm.

Preferred is an electroplating composition of the present invention, wherein the at least one kind of oxide-hydroxide particles have a particle size $D_{90}$ ranging from 0.5 μm to 15 μm, preferably from 0.75 μm to 10 μm, more preferably from 0.9 μm to 7.5 μm, even more preferably from 1.3 μm to 5 μm, most preferably from 1.5 μm to 2.5 μm.

Preferably, particle sizes are based on volume, and preferably determined by laser diffraction.

In the electroplating composition of the present invention preferably no hexavalent chromium is intentionally added to the electroplating composition. This includes for example chromic acid and chromium trioxide. Thus, the electroplating composition is substantially free, preferably does not comprise, hexavalent chromium (except very small amounts which may be unavoidably formed anodically).

In some cases, an electroplating composition of the present invention is preferred further comprising transition metal ions not being chromium, more preferably iron ions, nickel ions, copper ions, and/or zinc ions.

However, preferably the electroplating composition of the present invention does not additionally comprise iron ions.

However, preferably the electroplating composition of the present invention does not additionally comprise nickel ions.

However, preferably the electroplating composition of the present invention does not additionally comprise copper ions.

However, preferably the electroplating composition of the present invention does not additionally comprise zinc ions.

More preferred is an electroplating composition of the present invention, wherein the trivalent chromium ions form 90 wt.-% or more of all transition metal ions, based on the total weight of all transition metal ions, preferably 93 wt.-% or more, more preferably 95 wt.-% or more, most preferably 97 wt.-% or more. In most cases an electroplating composition of the present invention is preferred, wherein chromium species are the only transition metal species, most preferably trivalent chromium ions are the only transition metal ions.

The presence of said metal ions not being chromium (so called metal alloying elements) typically leads to respective chromium alloys. However, more typical and preferred are non-metal alloying elements in a respective chromium alloy layer, preferably carbon, nitrogen, and/or oxygen.

Preferred is an electroplating composition furthermore comprising one or more than one compound selected from the group consisting of

- one or more than one type of halogen ions, preferably bromide,
- one or more than one type of alkaline metal cations, preferably sodium and/or potassium,
- sulfate ions, and
- ammonium ions.

By adding one or more of the above-mentioned compounds the deposition of the chromium or chromium alloy layer during a respective deposition process can be improved, most preferably during the method of the present invention.

Preferably, the electroplating composition of the present invention comprises one or more than one type of halogen ions, preferably bromide ions and/or chloride ions. Preferably, bromide ions are present in a concentration of at least 0.06 mol/L, based on the total volume of the electroplating composition, more preferably of at least 0.1 mol/L, even more preferably at least 0.15 mol/L. Bromide anions particularly suppress effectively the anodic formation of hexavalent chromium species.

In some cases, an electroplating composition of the present invention is preferred, wherein the electroplating composition comprises chloride ions, preferably in addition to bromide ions. However, in other cases it is preferred that the electroplating composition is essentially free of, preferably does not comprise, chloride ions. However, this preferably does not exclude the presence of other halogen ions, preferably bromide ions. Preferably (if chloride ions are present), chloride ions are present in a total concentration ranging from 0.01 mol/L to 1.8 mol/L, based on the total volume of the electroplating composition, preferably ranging from 0.2 mol/L to 1.6 mol/L, more preferably ranging from 0.6 mol/L to 1.4 mol/L, most preferably ranging from 0.8 mol/L to 1.2 mol/L.

Preferably, the electroplating composition comprises one or more than one type of alkaline metal cations, preferably sodium and/or potassium, in a total concentration ranging from 0 mol/L to 0.5 mol/L, based on the total volume of the electroplating composition, more preferably from 0 mol/L to 0.3 mol/L, even more preferably from 0 mol/L to 0.1 mol/L, and most preferably from 0 mol/L to 0.08 mol/L.

Typically, rubidium, francium, and caesium ions are not utilized in an electroplating composition comprising trivalent chromium ions, although they are not excluded. However, preferably the one or more than one type of alkaline metal cations includes metal cations of lithium, sodium, and potassium, most preferably sodium and potassium. However, in some cases, an electroplating composition of the present invention is preferred not comprising said one or more than one type of alkaline metal cations. In such a case, preferably ammonium ions are alternatively preferred.

Preferably, the electroplating composition comprises ammonium ions, preferably in a total concentration ranging from 1 mol/L to 10 mol/L, based on the total volume of the electroplating composition, more preferably from 2 mol/L to 8 mol/L, even more preferably from 3 mol/L to 7 mol/L, and most preferably from 4 mol/L to 6 mol/L.

Preferably, the electroplating composition of the present invention comprises sulfate ions, preferably in a total amount ranging from 50 g/L to 250 g/L, based on the total volume of the electroplating composition.

Preferred is an electroplating composition of the present invention, being essentially free of, preferably not comprising, boric acid, preferably is essentially free of, preferably not comprising, boron-containing compounds.

Boron-containing compounds are not desired because they are environmentally problematic. When using boron-containing compounds, wastewater treatment is expensive and time consuming. Furthermore, boric acid typically shows poor solubility and therefore has the tendency to form precipitates. Although such precipitates can be solubilized upon heating, a respective electroplating composition cannot be utilized for electroplating during this time. There is a significant risk that such precipitates facilitate a reduced layer quality. Thus, the electroplating composition of the present invention is preferably essentially free, preferably does not comprise, any boron-containing compounds. Surprisingly, the electroplating composition of the present invention performs very well without boron-containing compounds, in particular in the above-mentioned (preferred) pH ranges.

In the context of the present invention, the term "does not comprise" and "not comprising", respectively, typically denotes that respective compounds and/or ingredients are not intentionally added to e.g. the electroplating composition. This does not exclude that such compounds are dragged in as impurities along with other relevant chemicals. However, the total amount of such compounds and ingredients is typically below the detection range and/or is not critical in the various aspects of the present invention.

Typically preferred is an electroplating composition of the present invention, being essentially free of, preferably not comprising, organic compounds containing divalent sulfur, preferably is essentially free of, preferably does not comprise, sulfur-containing compounds with a sulfur atom having an oxidation number below +6.

The present invention also refers to a method for depositing a chromium or chromium alloy layer on a substrate, the method comprising the following steps:

(a) providing the substrate, preferably a metallic substrate,
(b) providing an electroplating composition for depositing a chromium or chromium alloy layer, the composition comprising:
  (i) trivalent chromium ions,
  (ii) at least one complexing agent for the trivalent chromium ions, and
  (iii) at least one kind of oxide-hydroxide particles,
(c) contacting the substrate with said electroplating composition and applying an electrical current such that the chromium or chromium alloy layer is deposited on at least one surface of said substrate.

Preferably, the aforementioned regarding the electroplating composition of the present invention (preferably as described above as being preferred), applies likewise to the method of the present invention (preferably a method as described below as being preferred).

Preferred is a method of the present invention, wherein in step (c) the electrical current is a direct current.

Preferably, the direct current (DC) is a direct current without interruptions during the electroplating, wherein more preferably the direct current is not pulsed (non-pulsed DC). Furthermore, the direct current preferably does not include reverse pulses.

Preferred is a method of the present invention, wherein in step (c) the electrical current has a cathodic current density of at least 18 A/dm$^2$, preferably of at least 20 A/dm$^2$, more preferably of at least 25 A/dm$^2$, even more preferably of at least 30 A/dm$^2$, most preferably of at least 39 A/dm$^2$. Preferably, the cathodic current density is in a range from 18 A/dm$^2$ to 200 A/dm$^2$, more preferably from 20 A/dm$^2$ to 180 A/dm$^2$, more preferably from 23 A/dm$^2$ to 150 A/dm$^2$, even more preferably from 25 A/dm$^2$ to 120 A/dm$^2$, yet even more preferably from 27 A/dm$^2$ to 90 A/dm$^2$, most preferably from 30 A/dm$^2$ to 60 A/dm$^2$.

In some rare cases, a method of the present invention is preferred, wherein in step (c) the electrical current has a cathodic current density ranging from 100 A/dm$^2$ to 200 A/dm$^2$, preferably from 110 A/dm$^2$ to 190 A/dm$^2$, more preferably from 120 A/dm$^2$ to 180 A/dm$^2$, most preferably 130 A/dm$^2$ to 170 A/dm$^2$, even most preferably from 140 A/dm$^2$ to 160 A/dm$^2$. This most preferably applies if step (c) is performed for a comparatively short time period.

Typically, the substrate provided during the method of the present invention is the cathode during the electroplating process (i.e. in step (c)). Preferably, more than one substrate is provided simultaneously in step (c) of the method of the present invention.

Preferred is a method of the present invention, wherein in step (c) at least one anode is provided, wherein the at least one anode is independently selected from the group consisting of graphite anodes and mixed metal oxide on titanium anodes. Such anodes have shown to be sufficiently resistant in the electroplating composition of the present invention. Preferably, the at least one anode does not comprise any lead or chromium.

In step (c) of the method of the present invention a chromium or chromium alloy layer is deposited. Preferred is a chromium alloy layer. Preferably, alloying elements are one, more than one or all of elements selected from the group consisting of carbon, nitrogen, and oxygen. More preferably, the chromium alloy layer comprises at least carbon and oxygen. Carbon is typically present because of organic compounds usually present in the electroplating composition. These alloying elements are typically called non-metal alloying elements.

More preferably, the only alloying elements are carbon, nitrogen, and/or oxygen, more preferably carbon and/or oxygen, most preferably carbon and oxygen. Preferably, the chromium alloy layer contains 80 wt.-% chromium or more, based on the total weight of the chromium alloy layer, more preferably 85 wt.-% or more, even more preferably 90 wt.-% or more, most preferably 95 wt.-% or more.

In some case a method of the present invention is preferred, wherein the chromium alloy layer comprises (either in addition to said non-metal alloying elements or independently therefrom) one, more than one or all of the elements selected from the group consisting of nickel, copper, and zinc. These alloying elements are typically called metal alloying elements.

However, in many cases preferred is a method of the present invention, wherein the chromium alloy layer does not comprise one, more than one or all elements selected from the group consisting of sulphur, nickel, copper, zinc, and tin.

Particularly preferred is a method of the present invention, wherein the chromium alloy layer is essentially free of, preferably does not comprise, sulphur.

Particularly preferred is a method of the present invention, wherein the chromium alloy layer is essentially free of, preferably does not comprise, nickel.

Particularly preferred is a method of the present invention, wherein the chromium alloy layer is essentially free of, preferably does not comprise, copper.

Particularly preferred is a method of the present invention, wherein the chromium alloy layer is essentially free of, preferably does not comprise, zinc.

Particularly preferred is a method of the present invention, wherein the chromium alloy layer is essentially free of, preferably does not comprise, tin.

In some cases, preferred is a method of the present invention, wherein the chromium alloy layer is essentially free of, preferably does not comprise, iron. This is particularly preferred if the at least one kind of oxide-hydroxide particles comprises aluminium and not iron. This likewise applies if the at least one kind of oxide-hydroxide particles comprises aluminium and not manganese. In such a case it is preferred that the chromium alloy layer (alternatively or additionally) is essentially free of, preferably does not comprise, manganese.

Preferred is a method of the present invention, wherein in step (c) the electroplating composition has a temperature in a range from 20° C. to 90° C., preferably from 30° C. to 70° C., more preferably from 40° C. to 60° C., most preferably from 45° C. to 58° C.

In the preferred temperature range (in particular in the most preferred temperature range) the chromium and chromium alloy layer, respectively, is optimally deposited in step (c). If the temperature is significantly exceeding 90° C., an undesired vaporization occurs, which can negatively affect the concentration of the compositions' components. Furthermore, the undesired anodic formation of hexavalent chromium is significantly less suppressed. If the temperature is significantly below 20° C. the deposition is often insufficient.

Preferred is a method of the present invention, wherein step (c) is performed for a time period from 5 min to 500 min, preferably from 10 min to 300 min, more preferably from 15 min to 200 min, even more preferably from 20 min to 140, most preferably from 30 min to 80 min.

In some rare cases, a method of the present invention is preferred, wherein the step (c) is performed for a time period from 2 min to 10 min, preferably from 3 min to 9 min, more preferably from 4 min to 8 min, even more preferably from 5 min to 7 min. This is most preferred if the electrical current has a comparatively high current density, preferably of at least 100 A/dm$^2$, more preferably of at least 120 A/dm$^2$, even more preferably of at least 140 A/dm$^2$.

Preferred is a method of the present invention, wherein in step (c) the electroplating composition is stirred, preferably with a stirring rate in a range from 100 rpm to 900 rpm, preferably from 200 rpm to 700 rpm, more preferably from 300 rpm to 600 rpm, most preferably from 350 rpm to 500 rpm. A stirring is much preferred to provide an excellent homogenization/distribution of (iii) in the electroplating composition. If the stirring is too low, (iii) tends to sediment, which is not desired. If the stirring is too strong, the surface of the electroplating composition is in too much movement and an insufficient mist suppression is obtained.

By performing the method step (c) in the abovementioned preferred temperature ranges and/or (preferably and) for the preferred time periods and/or (preferably and) with the preferred stirring rates, particularly advantageous deposition kinetics during step (c) can be ensured.

Preferred is a method of the present invention further comprising after step (c) step (d) heat-treating the substrate obtained from step (c).

Preferred is a method of the present invention, wherein in step (d) the heat-treating is carried out at a temperature in a range from 80° C. to 600° C., preferably from 100° C. to 400° C., more preferably from 120° C. to 350° C., even more preferably from 135° C. to 300° C., most preferably from 150° C. to 250° C.

Preferred is a method of the present invention, wherein in step (d) the heat-treating is carried out for a time period from 1 hour to 10 hours, preferably from 2 hours to 4 hours.

By preferably performing a heat-treatment of the substrate, more preferably at the preferred temperatures and/or for the preferred time periods as aforementioned, the properties of the chromium and chromium alloy layer, respectively, is typically further improved in many cases (e.g. hardness).

Preferred is a method of the present invention, wherein the substrate comprises a metal or metal alloy, preferably comprises one or more than one metal selected from the group consisting of copper, iron, nickel and aluminum, more preferably comprises one or more than one metal selected from the group consisting of copper, iron, and nickel, most preferably comprises at least iron. The aforementioned metals preferably include respective alloys comprising at least one of said metals.

More preferably the substrate is a rod.

In many cases preferred is a substrate comprising at least one pre-coating, the at least one pre-coating preferably comprising (preferably is) a metal layer, more preferably a metal layer comprising at least one transition metal, even more preferably a metal layer comprising a transition metal of the 4$^{th}$ period (according to the periodic table of elements), most preferably a metal layer comprising nickel and/or chromium, even most preferably a nickel or nickel alloy layer, on which the chromium and chromium alloy layer, respectively, is applied to during step (c) of the method of the present invention. In particular preferred is a steel substrate pre-coated with a metal layer as defined above, preferably with a nickel or nickel alloy layer. An alternative or additional pre-coating is preferably a metal layer comprising chromium. However, preferably other pre-coatings are alternatively or additionally present. In many cases such a pre-coating significantly increases corrosion resistance compared to a metal substrate without such a pre-coating. However, in some cases the substrates are not susceptible to corrosion due to a corrosion inert environment (e.g. in an oil composition). In such a case a pre-coating, preferably a nickel or nickel alloy layer, is not necessarily needed.

Thus, in some cases a method of the present invention is preferred, wherein the substrate does not comprise a nickel and nickel alloy layer underneath the chromium and chromium alloy layer, respectively. The need for such a pre-coating is further reduced because the at least one kind of oxide-hydroxide particles in the electroplating composition utilized in the method of the present invention significantly increases corrosion resistance of the chromium and chromium alloy layer, respectively.

Generally, preferred is a method of the present invention, wherein in step (c) the chromium and chromium alloy layer, respectively, has a thickness in a range from 1.1 μm to 500 μm, preferably from 2 μm to 450 μm, more preferably from 4 μm to 400 μm, even more preferably from 6 μm to 350 μm, yet even more preferably from 8 μm to 300 μm, and most preferably from 10 μm to 250 μm. These are typically layer thicknesses of so-called hard chromium layers to provide sufficient wear resistance. Thus, the chromium and chromium alloy layer, respectively, obtained in the context of the present invention is preferably not a decorative layer.

In some further cases a method of the present invention is preferred, wherein in step (c) the chromium and chromium alloy layer, respectively, has a thickness of 15 μm or more, preferably of 20 μm or more, more preferably of 30 μm or more.

As initially mentioned, the present invention leads to a reduced brightness and/or reflectivity. Preferred is a method of the present invention, wherein in step (c) the chromium and chromium alloy layer, respectively, has a L* value of 70 or less, defined by CIELAB. Preferably, the L* value is determined in a specular component included mode (also abbreviated as SCI mode). This means that the specular reflectance is included with the diffuse reflectance during the measurement process. More preferably, it has a L* value of 69 or less, even more preferably of 68 or less. Such a L* value is significant because in the absence of (iii) the L* value is significantly above 70, for example 75 or more, more preferably 77 or more. However, a L* value of 70 or slightly less in the context of the present invention is not considered to be dark. Thus, preferred is a method of the present invention, wherein in step (c) the chromium and chromium alloy layer, respectively, has a L' value ranging from 57 to 70, preferably from 58 to 69, more preferably from 59 to 68, most preferably from 60 to 68.

Preferred is a method of the present invention, wherein in step (c) the chromium and chromium alloy layer, respectively, has, defined by CIELAB, an a* value ranging from −2 to +2 and/or a b* value ranging from −2 to +2.

More preferred is a method of the present invention, wherein in step (c) the chromium and chromium alloy layer, respectively, has, defined by CIELAB, an a* value ranging from −1.5 to +1.5 and/or a b* value ranging from −1.5 to +1.5.

Even more preferred is a method of the present invention, wherein in step (c) the chromium and chromium alloy layer, respectively, has, defined by CIELAB, an a* value ranging from −1 to +1 and/or a b* value ranging from −1 to +1.

Most preferred is a method of the present invention, wherein in step (c) the chromium and chromium alloy layer, respectively, has, defined by CIELAB, an a* value ranging from −0.5 to +0.5 and/or a b* value ranging from −0.5 to +0.5.

Preferred is a method of the present invention, wherein after step (c) the chromium and chromium alloy layer, respectively, has a hardness (HV) ranging from 650 to 950, preferably ranging from 680 to 900, more preferably ranging from 700 to 850, most preferably ranging from 720 to 800.

Further preferred is a method of the present invention, wherein after step (d) the chromium and chromium alloy layer, respectively, has a hardness (HV) of 950 or more. Preferably, after step (d) the hardness (HV) is ranging from 950 to 1900, preferably from 1000 to 1700, more preferably from 1050 to 1500, most preferably from 1100 to 1300.

The present invention also refers to a use of at least one kind of oxide-hydroxide particles in a trivalent chromium electroplating composition for depositing a hard chromium or hard chromium alloy layer having a L* value of 70 or less, defined by CIELAB.

Preferably, the aforementioned regarding the electroplating composition of the present invention (preferably as described above as being preferred) and/or the method of the present invention (preferably as described above as being preferred), applies likewise to the use of the present invention.

Furthermore, the present invention refers to a first substrate comprising a chromium or chromium alloy layer, the substrate further comprising optionally at least one pre-coating between the substrate and said chromium or chromium alloy layer, respectively, wherein the chromium and chromium alloy layer, respectively, comprises at least one kind of oxide-hydroxide particles.

Preferably, the aforementioned regarding the electroplating composition of the present invention (preferably as described above as being preferred) and/or the method of the present invention (preferably as described above as being preferred), applies likewise to the first substrate of the present invention.

Preferably, the chromium and chromium alloy layer utilized on the first substrate of the present invention is obtained by means of the method of the present invention.

Most preferred is said substrate of the present invention, wherein the at least one pre-coating comprises (preferably is) a metal layer, more preferably a metal layer comprising at least one transition metal, even more preferably a metal layer comprising a transition metal of the $4^{th}$ period, most preferably a metal layer comprising nickel and/or chromium, even most preferably a nickel or nickel alloy layer.

Particularly preferred is a first substrate of the present invention, wherein the chromium and chromium alloy layer, respectively, has a L* value of 70 or less, defined by CIELAB. More preferred is a L* value as defined above in the context of the method of the present invention.

Preferably, the present invention generally refers to hard chromium layers. Thus, preferred is a first substrate of the present invention, wherein the chromium and chromium alloy layer, respectively, has a thickness in a range from 1.1 μm to 500 μm, preferably from 2 μm to 450 μm, more preferably from 4 μm to 400 μm, even more preferably from 6 μm to 350 μm, yet even more preferably from 8 μm to 300 μm, and most preferably from 10 μm to 250 μm.

Preferred is a first substrate of the present invention, wherein the substrate comprises or is a metal rod.

The present invention furthermore refers to a more general substrate comprising a chromium or chromium alloy layer, the substrate further comprising optionally at least one pre-coating between the substrate and said chromium or chromium alloy layer, respectively, wherein the chromium and chromium alloy layer, respectively, comprises carbon, has a L* value of 70 or less, defined by CIELAB, and has a thickness of 4 μm or more.

Preferably, the aforementioned regarding the electroplating composition of the present invention (preferably as described above as being preferred) and/or the method of the present invention (preferably as described above as being preferred), applies likewise to this more general substrate of the present invention.

Most preferred is said substrate of the present invention, wherein the at least one pre-coating comprises (preferably is) a metal layer, more preferably a metal layer comprising at least one transition metal, even more preferably a metal layer comprising a transition metal of the $4^{th}$ period, most preferably a metal layer comprising nickel and/or chromium, even most preferably a nickel or nickel alloy layer.

More preferred is a more general substrate of the present invention, wherein the chromium and chromium alloy layer, respectively, has a thickness of 5 μm or more, preferably of 6 μm or more, even more preferably of 8 μm or more, yet even more preferably of 10 μm or more, most preferably of 15 μm or more.

Even more preferred is a more general substrate of the present invention, wherein the chromium and chromium alloy layer, respectively, has a thickness ranging from 4 μm to 500 μm, preferably from 5 μm to 450 μm, even more preferably from 6 μm to 400 μm, yet even more preferably from 8 μm to 350 μm, most preferably of 10 μm to 300 μm.

More preferred is a more general substrate of the present invention, wherein the chromium and chromium alloy layer, respectively, has a L* value of 69 or less, preferably of 68 or less.

Even more preferred is a more general substrate of the present invention, wherein the chromium and chromium alloy layer, respectively, has a L* value ranging from 57 to 70, preferably from 58 to 69, more preferably from 59 to 68, most preferably from 60 to 68.

More preferred is a more general substrate of the present invention, wherein the chromium and chromium alloy layer, respectively, comprises carbon in a total amount of 0.1 wt.-% or more, based on the total weight of said layer, preferably 0.5 wt.-% or more, more preferably 1 wt.-% or more. Preferably, the carbon is present in a total amount ranging from 0.1 wt.-% to 10 wt.-%, based on the total weight of said layer, preferably from 0.5 wt.-% to 8 wt.-%, more preferably from 1 wt.-% to 6 wt.-%. Preferably, this explicitly also applies to the first substrate of the present invention.

More preferred is a more general substrate of the present invention, wherein the chromium and chromium alloy layer, respectively, comprises less than 98 wt.-% chromium, based on the total weight of said layer, preferably 97 wt.-% or less, more preferably 96 wt.-% or less, even more preferably 95 wt.-% or less, yet even more preferably 94 wt.-% or less. Even more preferred is a substrate of the present invention, wherein the chromium and chromium alloy layer, respectively, comprises chromium in a total amount ranging from 88 wt.-% to 98 wt.-%, based on the total weight of said layer, preferably from 89 wt.-% to 97 wt.-%, more preferably from 90 wt.-% to 96 wt.-%, most preferably from 91 wt.-% to 95 wt.-%. Preferably, this explicitly also applies to the first substrate of the present invention.

More preferred is a more general substrate of the present invention, wherein the chromium and chromium alloy layer, respectively, comprises oxygen, preferably in a total amount ranging from 1 wt.-% to 5 wt.-%, based on the total weight of said layer, preferably from 1.5 wt.-% to 4 wt.-%. Preferably, this explicitly also applies to the first substrate of the present invention.

In some cases, a more general substrate of the present invention is preferred, wherein the chromium and chromium alloy layer, respectively, is substantially free of, preferably does not comprise, sulfur.

More preferred is a more general substrate of the present invention, wherein the chromium and chromium alloy layer, respectively, has a hardness (HV) ranging from 650 to 2000, preferably ranging from 700 to 1700, more preferably ranging from 750 to 1500, most preferably ranging from 800 to 1300.

Preferably, the aforementioned features regarding the amount of chromium, carbon, and oxygen are typically obtained if the chromium and chromium alloy layer, respectively, is deposited from a trivalent chromium electroplating composition. This most preferably applies to the presence of carbon, which is a typical and very prominent element resulting from depositing from a trivalent chromium electroplating composition. The aforementioned features, most particularly carbon, are preferably a typical distinction over a corresponding layer deposited from a hexavalent chromium electroplating bath.

If applicable and not stated otherwise, the aforementioned features regarding the more general substrate of the present invention preferably also apply to the first substrate of the present invention.

The present invention is described in more detail by the following non-limiting examples.

EXAMPLES

For a number of experiments, respective test electroplating compositions were prepared (volume: appr. 850 mL) as shown in Table 1 for comparative examples not according to the invention and Table 2 for examples according to the invention. Generally, and if not stated otherwise, the compositions contained about 20 g/L trivalent chromium ions, about 4 mol/L formate anions, about 90 mmol/L bromide ions, and about 0.5 mol/L chloride ions. The compositions did not contain boric acid nor any boron-containing compounds and no organic compounds with divalent sulfur. The pH was adjusted with ammonia to 5.4. Experiments were carried out with different particle sizes, particle concentrations, layer thicknesses, and cathodic current densities (abbreviated as CCD) (for further information see Tables 1 and 2).

In each experiment, the respective electroplating composition was subjected to electroplating to obtain a respective chromium or chromium alloy layer on a substrate (mild steel rod with 10 mm diameter). As anodes a graphite anode was used. Electrodeposition was carried out at various current densities (see Tables 1 and 2) for 30 to 60 minutes at 50° C. under agitation (450 rpm). The layer thickness was always within a range from 10 μm to 40 μm, depending on current densities applied (see Tables 1 and 2).

In each experiment (i.e. comparative and according to the invention) the respective chromium or chromium alloy layer comprised 1 to 5 wt.-% carbon. The total amount of chromium was below 98 wt.-%.

TABLE 1

Overview experimental setup comparative examples

| Exp. | Particles | c [g/L] | $D_{50}$ [um] | d [μm] | CCD [A/dm$^2$] |
|---|---|---|---|---|---|
| C1 | — | — | — | 10 | 30 |
| C2 | — | — | | 25 | 30 |
| C3 | — | — | — | 10 | 40 |
| C4 | — | — | — | 25 | 40 |
| C5 | gamma-$Al_2O_3$ | 10 | 1 | 10 | 30 |
| C6 | gamma-$Al_2O_3$ | 10 | 1 | 25 | 30 |
| C7 | gamma-$Al_2O_3$ | 10 | 1 | 10 | 40 |
| C8 | gamma-$Al_2O_3$ | 10 | 1 | 25 | 40 |
| C9 | gamma-$Al_2O_3$ | 20 | 1 | 10 | 30 |
| C10 | gamma-$Al_2O_3$ | 20 | 1 | 25 | 30 |
| C11 | gamma-$Al_2O_3$ | 20 | 1 | 10 | 40 |
| C12 | gamma-$Al_2O_3$ | 20 | 1 | 25 | 40 |
| C13 | gamma-$Al_2O_3$ | 10 | 8.2 | 10 | 30 |
| C14 | gamma-$Al_2O_3$ | 10 | 8.2 | 25 | 30 |
| C15 | gamma-$Al_2O_3$ | 10 | 8.2 | 10 | 40 |
| C16 | gamma-$Al_2O_3$ | 10 | 8.2 | 25 | 40 |
| C17 | gamma-$Al_2O_3$ | 20 | 8.2 | 10 | 30 |
| C18 | gamma-$Al_2O_3$ | 20 | 8.2 | 25 | 30 |
| C19 | gamma-$Al_2O_3$ | 20 | 8.2 | 10 | 40 |
| C20 | gamma-$Al_2O_3$ | 20 | 8.2 | 25 | 40 |
| C21 | alpha-$Al_2O_3$ | 10 | 4.6 | 10 | 30 |
| C22 | alpha-$Al_2O_3$ | 10 | 4.6 | 25 | 30 |
| C23 | alpha-$Al_2O_3$ | 10 | 4.6 | 10 | 40 |
| C24 | alpha-$Al_2O_3$ | 10 | 4.6 | 25 | 40 |
| C25 | alpha-$Al_2O_3$ | 20 | 4.6 | 10 | 30 |
| C26 | alpha-$Al_2O_3$ | 20 | 4.6 | 25 | 30 |
| C27 | alpha-$Al_2O_3$ | 20 | 4.6 | 10 | 40 |
| C28 | alpha-$Al_2O_3$ | 20 | 4.6 | 25 | 40 |

TABLE 1-continued

Overview experimental setup comparative examples

| Exp. | Particles | c [g/L] | $D_{50}$ [um] | d [μm] | CCD [A/dm$^2$] |
|---|---|---|---|---|---|
| C29 | alpha-$Al_2O_3$ | 10 | 6.5 | 10 | 30 |
| C30 | alpha-$Al_2O_3$ | 10 | 6.5 | 25 | 30 |
| C31 | alpha-$Al_2O_3$ | 10 | 6.5 | 10 | 40 |
| C32 | alpha-$Al_2O_3$ | 10 | 6.5 | 25 | 40 |
| C33 | alpha-$Al_2O_3$ | 20 | 6.5 | 10 | 30 |
| C34 | alpha-$Al_2O_3$ | 20 | 6.5 | 25 | 30 |
| C35 | alpha-$Al_2O_3$ | 20 | 6.5 | 10 | 40 |
| C36 | alpha-$Al_2O_3$ | 20 | 6.5 | 25 | 40 |

"c [g/L]" refers to the total amount of particles
"$D_{50}$ [μm]" refers to the particle size
"d [μm]" refers to the layer thickness of the deposited layer
"CCD" denotes cathodic current density According to Table 1, only showing comparative examples, in comparative electroplating compositions of examples (C1) to (C4) no particles were used, thereby defining the typical reference color of a substrate with a hard chromium layer thereon obtained from a trivalent chromium deposition bath free of particles. The hard chromium layers are shiny and have a very similar brightness compared to a layer obtained from a hexavalent chromium deposition bath.

According to Table 1, in a number of further experiments (C5) to (C36) aluminium oxide particles were utilized and a plurality of parameters was varied. In the context of the present invention, such particles are no oxide-hydroxide particles but rather only oxide particles.

Comparative electroplating composition of Comparative Example (C4) was further tested without any chloride (but otherwise being identical; data not shown). No optical difference was observed compared to (C4).

However, in every comparative example, the following color was determined: L* 78-79; a* −0.1 to +0.1; b* +0.6 to +1. As already mentioned above, in each comparative example the deposited layer was shiny with a silver-like brightness.

TABLE 2

Overview experimental setup examples according to the invention

| Exp. | Particles | c [g/L] | $D_{50}$ [μm] | d [μm] | CCD [A/dm$^2$] |
|---|---|---|---|---|---|
| E1 | gamma-AlO(OH) | 5 | 0.9 | 10 | 30 |
| E2 | gamma-AlO(OH) | 5 | 0.9 | 25 | 30 |
| E3 | gamma-AlO(OH) | 5 | 0.9 | 10 | 40 |
| E4 | gamma-AlO(OH) | 5 | 0.9 | 25 | 40 |
| E5 | gamma-AlO(OH) | 10 | 0.9 | 10 | 30 |
| E6 | gamma-AlO(OH) | 10 | 0.9 | 25 | 30 |
| E7 | gamma-AlO(OH) | 10 | 0.9 | 10 | 40 |
| E8 | gamma-AlO(OH) | 10 | 0.9 | 25 | 40 |
| E9 | gamma-AlO(OH) | 20 | 0.9 | 10 | 30 |
| E10 | gamma-AlO(OH) | 20 | 0.9 | 25 | 30 |
| E11 | gamma-AlO(OH) | 20 | 0.9 | 10 | 40 |
| E12 | gamma-AlO(OH) | 20 | 0.9 | 25 | 40 |
| E13 | gamma-AlO(OH) | 20 | 0.9 | 25 | 50 |
| E14 | gamma-AlO(OH) | 20 | 0.9 | 25 | 60 |
| E15 | gamma-AlO(OH) | 20 | 0.9 | 20 | 70 |
| E16 | gamma-AlO(OH) | 20 | 0.9 | 15 | 80 |
| E17 | gamma-AlO(OH) | 20 | 0.9 | 15 | 100 |
| E18 | gamma-AlO(OH) | 10 | 1.8 | 10 | 30 |
| E19 | gamma-AlO(OH) | 10 | 1.8 | 25 | 30 |
| E20 | gamma-AlO(OH) | 10 | 1.8 | 10 | 40 |
| E21 | gamma-AlO(OH) | 10 | 1.8 | 25 | 40 |
| E22 | gamma-AlO(OH) | 20 | 1.8 | 10 | 30 |
| E23 | gamma-AlO(OH) | 20 | 1.8 | 25 | 30 |
| E24 | gamma-AlO(OH) | 20 | 1.8 | 10 | 40 |
| E25 | gamma-AlO(OH) | 20 | 1.8 | 25 | 40 |
| E26 | gamma-AlO(OH) | 10 | 2.7 | 10 | 30 |
| E27 | gamma-AlO(OH) | 10 | 2.7 | 25 | 30 |
| E28 | gamma-AlO(OH) | 10 | 2.7 | 10 | 40 |
| E29 | gamma-AlO(OH) | 10 | 2.7 | 25 | 40 |
| E30 | gamma-AlO(OH) | 20 | 1.8 | 10 | 30 |
| E31 | gamma-AlO(OH) | 20 | 1.8 | 25 | 30 |
| E32 | gamma-AlO(OH) | 20 | 1.8 | 10 | 40 |
| E33 | gamma-AlO(OH) | 20 | 1.8 | 25 | 40 |

"c [g/L]" refers to the total amount of particles
"$D_{50}$ [μm]" refers to the particle size
"d [μm]" refers to the layer thickness of the deposited layer
"CCD" denotes cathodic current density According to Table 2, only showing examples according to the invention, all electroplating compositions comprise oxide-hydroxide particles. The therefrom obtained hard chromium layers are less shiny compared to the comparative examples and in particular show a dull, matte appearance. In all examples according to the invention the following color was determined: L* 68-69; a* −0.1 to +0.1; b* −0.1 to +0.2. Furthermore, in all examples according to the invention the optical appearance was identical, thus, basically independent from the various parameters changed throughout (E1) to (E33). Furthermore, in all examples according to the invention, the hardness (HV) after step (c) was between 700 and 800 and thereby slightly lower compared to the hardness obtained after step (c) of comparative examples (C1) to (C4).

In addition, (E8) was further tested without any chloride (but otherwise being identical; data not shown). No optical difference was observed compared to (E8) or any other example according to the invention.

As shown in Table 2, only a mixed oxide-hydroxide species showed the desired matte appearance. In comparative experiments utilizing only an oxide particle species, the desired change in brightness did not occur.

In addition, the number and width of cracks was investigated. A comparison between (C1) to (C4) with (C5) to (C12) showed that utilizing oxide particles reduces the number of tiny cracks counted on a layer cross section approximately by 10%. However, comparing (C1) to (C4) with all examples of the invention showed a reduction of 60 to 80% if oxide-hydroxide particles were present.

Furthermore, the presence of oxide-hydroxide particles reduces the width of the remaining cracks significantly.

Interestingly, (C13) to (C36) showed no improvement at all, i.e. no reduced number of cracks compared to (C1) to (C4).

The invention claimed is:

1. A method for depositing a chromium or zinc-free chromium alloy layer on a substrate, the method comprising the following steps:

(a) providing the substrate, (b) providing an electroplating composition for depositing a chromium or zinc-free chromium alloy layer, the composition comprising:

(i) trivalent chromium ions, (ii) at least one complexing agent for the trivalent chromium ions, and (iii) particles of at least one metal oxide-hydroxide, (c) contacting the substrate with said electroplating composition and applying an electrical current such that the chromium or zinc-free chromium alloy layer is deposited on at least one surface of said substrate.

2. The method of claim 1, wherein in step (c) the chromium or zinc-free chromium alloy layer, respectively, has a thickness in a range from 1.1 μm to 500 μm.

3. The method of claim 1, wherein in step (c) the chromium or zinc-free chromium alloy layer, respectively, has a L* value of 70 or less, defined by CIELAB.

4. The method of claim 1, wherein in step (c) the chromium or zinc-free chromium alloy layer, respectively, has, defined by CIELAB, an a* value ranging from −2 to +2 and/or a b* value ranging from −2 to +2.

5. The method of claim 1, wherein after step (c) the chromium or zinc-free chromium alloy layer, respectively, has a hardness (HV) ranging from 650 to 950.

* * * * *